US011215006B1

(12) United States Patent
Crittenden

(10) Patent No.: US 11,215,006 B1
(45) Date of Patent: Jan. 4, 2022

(54) EXTERIOR VENTILATOR DOOR AND VENTILATOR ASSEMBLY FOR BRINGING FRESH AIR INTO A STRUCTURE

(71) Applicant: Jerry G. Crittenden, Phoenix, AZ (US)

(72) Inventor: Jerry G. Crittenden, Phoenix, AZ (US)

( * ) Notice: Subject to any disclaimer, the term of this patent is extended or adjusted under 35 U.S.C. 154(b) by 0 days.

(21) Appl. No.: 16/873,156

(22) Filed: Feb. 14, 2020

(51) Int. Cl.

| | |
|---|---|
| ***E06B 7/02*** | (2006.01) |
| ***F24F 7/007*** | (2006.01) |
| ***F24F 7/06*** | (2006.01) |
| ***F24F 13/10*** | (2006.01) |
| ***F24F 13/08*** | (2006.01) |
| *F24F 13/28* | (2006.01) |

(52) U.S. Cl.
CPC ..... *E06B 7/02* (2013.01); *F24F 7/007* (2013.01); *F24F 7/065* (2013.01); *F24F 13/085* (2013.01); *F24F 13/10* (2013.01); *E06B 2007/023* (2013.01); *F24F 13/28* (2013.01)

(58) Field of Classification Search
CPC ..... E06B 7/02; E06B 2007/023; F24F 7/007; F24F 7/065; F24F 13/085; F24F 13/10; F24F 13/28
USPC ..... 454/195, 211, 265, 277
See application file for complete search history.

(56) References Cited

U.S. PATENT DOCUMENTS

| | | | | |
|---|---|---|---|---|
| 3,262,491 | A * | 7/1966 | Selhost | F24F 1/02 165/48.1 |
| 4,560,395 | A * | 12/1985 | Davis | F24F 3/1603 96/381 |
| 4,662,270 | A * | 5/1987 | Fiddler | F25D 17/047 454/195 |
| 9,109,389 | B1 * | 8/2015 | Crittenden | B29C 43/18 |
| 9,791,160 | B2 * | 10/2017 | Yamaguchi | F24F 3/00 |
| 10,012,408 | B1 * | 7/2018 | Crittenden | E06B 7/28 |
| 2006/0211362 | A1 * | 9/2006 | Levy | F24F 13/06 454/186 |

* cited by examiner

*Primary Examiner* — Edelmira Bosques
*Assistant Examiner* — Dana K Tighe
(74) *Attorney, Agent, or Firm* — H. Gordon Shields

(57) ABSTRACT

A stile and rail frame exterior solid core door brings fresh outside air into a structure horizontally through a ventilator assembly. The ventilator assembly includes an upper housing. The upper housing includes a filter for filtering the fresh air and a fan in a fan housing provides a flow of air into the upper housing and through the filter and into the structure horizontally through the door. Air flow through the housing is controlled by a movable damper in the upper housing. An actuator moves the damper in response to electronic input signals. Stale air is exhausted from the structure in a similar manner, through a fan in a lower housing. The upper and lower housings with their fans extend substantially the width of the door between the stiles. Electronic elements are in a housing in the door, and respond to information appropriately sensed by sensor elements placed in the structure. For new construction, the ventilator assembly may be located in a transom area above the door or may be vertically oriented adjacent to a door or as desired.

19 Claims, 2 Drawing Sheets

EXTERIOR VENTILATOR DOOR AND VENTILATOR ASSEMBLY FOR BRINGING FRESH AIR INTO A STRUCTURE

BACKGROUND OF THE INVENTION

Field of the Invention

This invention pertains to an exterior ventilator door having elements for receiving fresh outdoor air and discharging the fresh outdoor air horizontally through the door and into the structure to which the door is secured.

Description of the Prior Art

Exterior doors are generally solid and do not allow air to pass through them. Bringing fresh outside air into a structure prior to the advent of the present exterior door was either opening a window or an exterior door. That is a most logical manner in which outdoor air is introduced into a structure, and is a very easy solution. The problem with such a solution is simply a matter of opening and closing a window or windows and then shutting them again. The simple solution also becomes acute when the structure, typically a home, is left without anyone being present. An open window is an invitation to burglars. Moreover, open windows and a vacant home in a rain storm invites water damage of from simple wetting to severe.

An open door is even more impractical, for obvious reasons, including all of the above negative comments for open windows.

The present invention solves all of the problems discussed above for open windows and doors, regardless of window or door screens. Outside air is introduced into a structure, such as a home, without the problems associated with open windows and doors and a vacated structure.

U.S. Pat. Nos. 10,012,408 and 10,337,238 disclose bringing fresh outside air into structures by providing ducts in the doors extending vertically in the doors. Stale inside air is vented or exhausted from the structures by reversing the flow of air.

The ventilator door of the present invention provides a practical solution to bringing fresh outdoor air into a structure, typically a home, by providing a horizontal air flow path through an exterior door. Virtually the entire width of the door is used for the flow of air. Heat sink elements are disposed in the horizontal flow of air and provide both heating and cooling for the flow of air, depending on the temperature differentials involved, and also provide sound deadening features for the structure.

The present invention may be applied to any type of exterior door, a flush door, a steel door, a fiberglass door, a stile and rail door, a composite materials door, or virtually any other exterior door for homes and apartments. All of the doors include basic frames, well known and understood, according to their specific construction.

The present invention comprises an exterior ventilator door having at least a single horizontally extending ventilator assembly housing extending through an exterior door and a fan or blower, with its own housing, within the ventilator assembly housing, for moving outside air horizontally into the interior of a structure. The air flow through the door is conditioned either by cooling or by heating, depending on the temperature difference between outside ambient air temperature and inside ambient air temperature, by heat sink elements. The heat sink elements are in heat transfer contact with the ventilator assembly housing. An upper incoming air fan housing and a lower exhaust air fan housing each has its own blower or fan.

SUMMARY

The invention described and claimed herein comprises a ventilator door having a housing extending horizontally through the door to define a conduit for providing a flow of fresh outside air into a structure by means of a fan in the housing. A heat sink element either helps to cool the incoming fresh air or to provide heat to warm the incoming fresh air, as required or desired. The fan or blower provides the flow of air. An upper ventilator assembly housing and a lower ventilator assembly housing each has a fan in a fan housing to provide separate flows of incoming fresh air and exhausting stale air. Ventilator assemblies with their fan housings extend virtually the entire width of the door between the door frame members.

Among the objects of the present invention include the following:

To provide and new and useful ventilator door;

To provide a new and useful exterior door permitting air to flow through horizontally through the door;

To provide a new and useful exterior door with horizontal housing or duct elements for the passage of fresh outside air into a structure to which the door is secured;

To provide a new and useful door having an upper air intake duct or housing and a lower air exhaust duct or housing;

To provide a new and useful exterior door providing air flow through the door in a housing or duct extending horizontally in the door and through which the air flows through the door;

To provide a new and useful door for providing a horizontal flow of air through the door for providing fresh outside air into a structure;

For providing a new and useful ventilator door for providing a horizontal flow of air through duct elements for providing outside air into a structure and for exhausting stale air out of the structure;

To provide a new and useful exterior ventilator door;

To provide a new and useful exterior door for bringing fresh outside air into a structure through a horizontal duct;

To provide a new and useful exterior ventilator door through which air flows horizontally into a structure;

To provide a new and useful ventilator door having at least a single horizontal duct or housing through which air flows through the door;

To provide a new and useful door having a plurality of horizontal ducts or housings through which air flows through the door into and out of a structure;

To provide a new and useful door for conditioning air flow through the door;

To provide a new and useful door capable of cooling outside air as it flows through the door into a structure;

To provide a new and useful door capable of warming outside air as it flows through the door into a structure;

To provide a new and useful exterior door having at least a single horizontally extending duct or housing to which are secured heat sink elements through which air flows into a structure;

To provide a new and useful ventilator assembly for bringing fresh air into a structure;

To provide a new and useful ventilator assembly for an exterior door for bringing fresh air into a structure;

To provide a new and useful ventilator assembly for bringing fresh air horizontally into a structure;

To provide a new and useful ventilator assembly for bringing fresh air horizontally into a structure;

To provide a new and useful ventilator assembly for bringing fresh air horizontally through a door;

To provide a new and useful ventilator assembly for bringing fresh air horizontally through the transom area of a door;

To provide a new and useful exterior door having an outside opening and an inside opening and a fan for providing an air flow and a movable damper to control the air flow between the outside and inside openings to provide a horizontal air flow into a structure; and To provide a new and useful door having a thermal barrier for limiting the heat transfer into the air flow from an outside housing through which outside air flows into the structure.

DESCRIPTION OF THE PREFERRED EMBODIMENT

Figure 1:
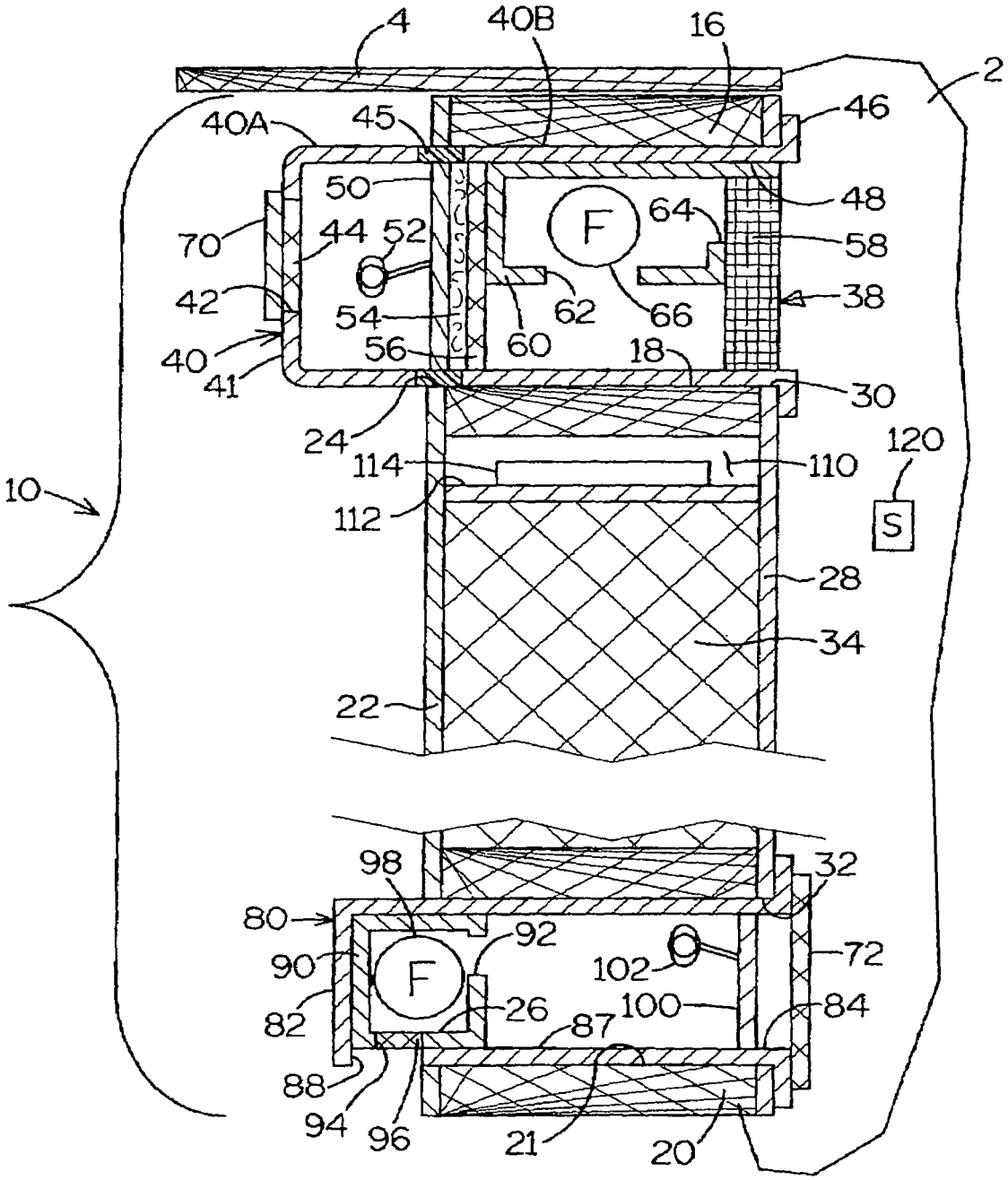
FIG. 1 is a schematic side view in partial section of an exterior ventilator door 10.
Figure 3:
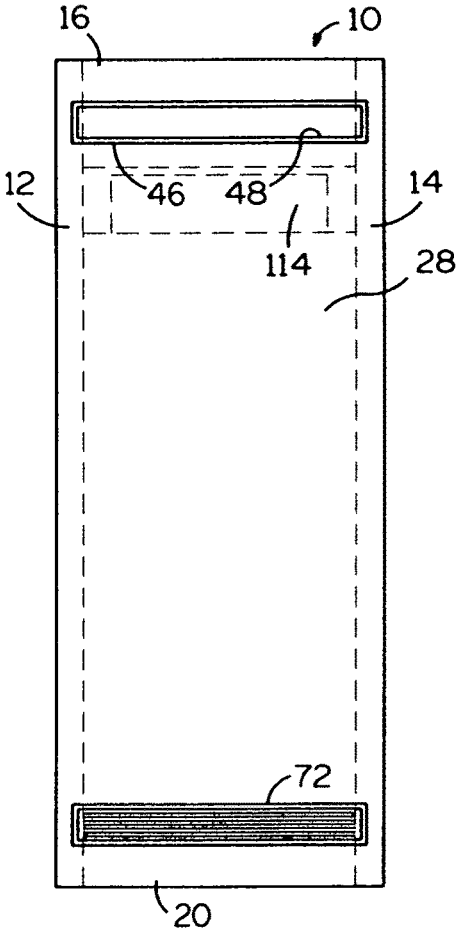
FIG. 3 is a rear view of the door 10 of FIG. 1.

FIG. 1 is a schematic side view in partial section through an exterior door 10. FIG. 3 is a rear, or inside, view of the door 10 of FIG. 1. For the following discussion reference may be made to both FIGS. 1 and 3.

The door 10 is situated in a structure 2. The structure 2 includes an overhang or jamb header 4 under which a portion of the door 10 is disposed.

The terms "outside" or "exterior" and "inside" pertain to the relationship of the door to the structure to which the door is secured. That is, the "outside" of the door 10 refers to the face of the door through which fresh air enters through door. The "inside" of the door 10 refers to the face of the door from which fresh outside air enters the structure to which the door is secured. The term "ventilator" refers to a type of door through which fresh air passes through to provide fresh air to the inside of a structure. Thus, the door 10 of the present invention is an exterior "ventilator" door for both home and apartment structures.

The door 10 is schematically illustrated as a solid core door of conventional stile and rail frame construction. The scale has been exaggerated so as to clearly show elements of the structure. The door 10 has a frame including a pair of spaced apart stiles 12 and 14 appropriately secured to an upper or top rail 16 and a bottom or lower rail 20. See FIG. 2, with the stiles and rails shown in dotted line. It will be shown best in FIG. 1 that the top rail 16 extends vertically longer or taller than in an "ordinary" door to accommodate elements through which exterior air flows into the structure 2. The top rail 16 includes an opening 18 to accommodate the exterior air flow elements. This will be discussed in detail below and is shown in both FIGS. 1 and 2.

An outside skin 22 and an inside skin 28 are appropriately secured to the stile and rail frame.

The outside skin 22 includes an upper intake opening 24 and a lower exhaust or outflow opening 26. The inside skin 28 includes corresponding upper opening 30 and a lower vent or exhaust opening 32. The openings 24, 26, and 30, 32, are generally parallel to each other.

Within the door 10 is a solid core, preferably insulation, 34.

Secured to the door 10 and extending through the opening 18 in the top rail 16 is a ventilator assembly 38. The ventilator assembly 38 comprises a horizontally extending duct through which outside air is brought into the structure 2. The ventilator assembly 38 includes a housing 40, which is an upper housing. The housing 40 includes an outside end wall 41 which extends outwardly from the planar portion of the door 10 as defined by the outer skin 22. There is a generally open end to the housing 40, remote from the outside wall 41, and generally parallel to the end wall 41, comprising an opening 48 and a vertically extending inside flange 46. The outside air flows into the structure 2 through the opening 48.

The upper housing 40 extends outwardly of the structure 2 and beneath the overhang or header 4. For apartment structures where the "outside" door opens in a corridor, there will of course be no overhang structure.

An opening 42 in the end wall 41 exterior or outer portion of the housing 40 is covered by a screen 44. At the opposite end of the housing 40, the flange 46 is disposed against the inside skin 28 about the opening 30 in the skin 28. The housing 40 is secured to the door 10 through the flange 46 and through the skin 28 and into the top rail 16 by appropriate fasteners.

Exterior or outside air flows into the housing 40 through the screen 44. The flow of outside air is controlled by a damper 50. The damper 50 is moved in response to an actuator 52. Air passes preferably through a pair of filters 54 and 56. The filter 54 is preferably a charcoal filter, and the filter 56 is preferably a HEPA filter.

Adjacent to the filter 56 is a fan housing 60. The fan housing 60 includes a lower opening 62 through which fresh outside air flows into the fan housing and to a fan 66. The flow of air produced by the fan 66 flows outwardly from the fan housing 60 through an outer fan housing discharge opening 64.

Air moves through the filters 54 and 56 and through the opening 62 in response to the fan 66. From the fan 66 air flows through the opening 64 and through a heat sink 58 and outwardly from the door and into the structure 2 through the opening 48 in the upper housing 40. The heat sink 58 is preferably an aluminum honeycomb heat sink and is disposed in the opening 48 in the housing 40. Air flows through the heat sink 58 in the opening 48 into the structure 2.

In addition to the heat sink function, the aluminum honeycomb heat sink 58 also provides a sound dampening function. The heat sink 58 is in heat transfer contact with the housing 40 and with the fan housing 60, both of which are heat conductive.

For exterior doors, exposure to the sun may result in excessive heat gain for the housing 40 transmitted to the heat sink 58 and thus heated air flowing into the structure 2. Accordingly, a thermal barrier 45 may be inserted to separate the housing 40 into an outside portion 40A and an inside portion 40B. Such a thermal barrier is accomplished by material which does not conduct heat and is inserted between the two portions 40A and 40B of the housing 40.

The purpose of the thermal barrier 45 is to thermally isolate the incoming air flow from the heated portion 40A of the housing 40. Or, in other words, to thermally isolate the inside portion 40B of the housing 40 from the heated portion 40A so as to prevent the incoming outside air from being heated from the housing portion 40A. Thus, the incoming outside air flow is cooled, or heated, as it flows through the heat sink 58 is accordance with the conditioned inside air.

The thermal barrier 45 is shown as plastic material, but any appropriate material that blocks or limits thermal conductivity may be used. Moreover, an air gap, with appropriate connective elements may also be used. Such arrangement is shown in FIG. 2.

Figure 2:
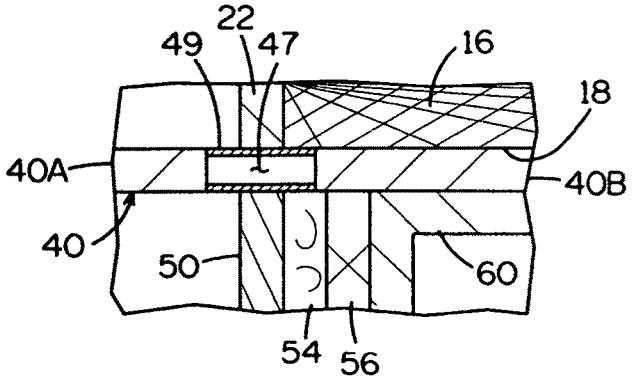
FIG. 2 is an enlarged fragmentary view in partial section of an alternate embodiment of the structure of FIG. 1.

FIG. 2 is an enlarged view in partial section of an air gap thermal barrier for use the door 1, an alternate to the solid thermal barrier shown in FIG. 1. FIG. 2 is enlarged to show the relation of the various elements involved. A portion of the outside housing 40A is shown extending through the opening 18 in the top rail 16.

A portion of the outside skin 22 is shown, with the opening 24 through which the housing 40 and its outside portion 40A extends. The upper portions of the damper 50 and the filters 54 and 56 also shown.

An air gap 47 is shown between the portions 40A and 40B is shown providing a thermal barrier between the outside and inside portions 40A and 40B, thus insulating the air flow from the heat of the outside portion 40A of the housing 40. The air gap 47 also provides a thermal barrier for the fan housing 60.

The air gap 47 is shown with appropriate elements 49 structurally connecting the housing portions 40A and 40B. The elements 49 are preferably also thermally non-conductive but structurally connective.

Like the top rail 16, the lower rail 20 is vertically longer than a typical rail to provide for an opening 21 to receive a lower housing 80.

At the lower portion of the door 10 are the openings 26 and 32 in the skins 22 and 28, respectively, and the lower housing 80 extends through the openings 26 and 32 in the skins 22 and 28, respectively, and through the opening 21 in the bottom rail 20.

The housing 80 is of a generally hexagonal configuration, with five sides or walls, including an outer end wall 82. The outer or outside end wall 82 is disposed outwardly from the planar portion of the door 10 as defined by the skins 22 and 28, similarly to the outer end wall 41 of the upper housing 40. At the opposite end of the housing 80, which is generally open, remote from the end wall 82, there is an opening 84 for receiving a flow of stale or exhaust air from the structure 2.

An outwardly extending flange 86 of the lower housing 80 is disposed against the inside skin 28 about the opening 84. The lower housing 80 is secured to the door 10 through the flange 86 by appropriate fasteners.

There is an opening 88 in the bottom wall 87 through which air flows out of the lower housing 80.

A grill 70 covers the opening 42 in the end wall 42 of the upper housing 40. A grill 72 covers the opening 84 in the lower housing 80.

A fan housing 90 is disposed in the lower housing 80. The fan housing 90 includes an opening 92 for receiving stale or exhaust air from the structure 2 through the grill 72. The flow of air through the grill 72 and the opening 84 is controlled by a damper 100. The damper 100 is controlled by an actuator 102.

The fan housing 90 includes a bottom opening 94. A screen 96 is disposed in the opening 94. Air flow through the housing 80 and the fan housing 90 is provided by a fan 98. Thus, stale air is exhausted from the structure 2 by the fan 98 and the housings 80 and 90 according to the position or setting of the damper 100.

In turn, the damper actuators 52 and 102 are controlled by electronic elements located in a housing 114 in a chamber 110. The chamber 110 is beneath the top rail 16 and extends between the stiles 12 and 14. The chamber 110 includes a bottom plate or shelf 112. The compartment 110 extends between the bottom of the top rail 16 and the plate 112. Appropriate electronic elements, including electrical power elements for providing power for the fans 66 and 98, are located in the housing 114 in the compartment 110.

Sensors 120 provide input information to the electronics in the housing 114 and are located as desired within the structure 2 and within the door. The sensors 120 are schematically illustrated. The use of microprocessors and sensors is well known and understood in contemporary usage for controlling actuators. Also, elements for bringing electrical power into the door 10 are well known and understood and accordingly are not shown.

As shown in FIGS. 1 and 3, the upper housing 40 and the fan 66, and the opening at the flange 48 extend virtually the entire width of the door 10 between the stiles 12 and 14 of the door frame. The lower housing 80 with the fan 98 likewise extend the entire width of the door 10 between the stiles 12 and 14 of the door frame. Air flow into and out of the door 10, and thus the structure 2, is accordingly maximized in a minimum space.

Note that wiring for the fans and the damper actuators are not shown for purposes of clarity. Similarly, hardware for the door 10, well known and understood in the art, is also not shown.

An appropriate power source for the electronics in the housing 114 may be connected inductively, through a hinge, or in any other appropriate manner.

Contemporary electronics allow many functions to be controlled by smart phones, computers, microprocessors, and the like. Accordingly, the electronics in the housing 114 may control, or be controlled, in a variety of ways. Electronics may control not only the fans 66 and 96 but also exhaust fans appropriately located throughout a structure when the fans are actuated, cameras, indoors and outdoors or in a door, or other desired elements. The possibilities are limited only by a users desires and the contemporary technology.

The opposite is also very possible, the electronics in the housing may be remotely controlled by a computer, smart phone, or other remote device. A multitude or plurality of sensors may also be installed with the present apparatus, such as temperature sensors not only with the ducts and blowers, but also in other locations in the structure.

While the door of the present invention brings fresh outside air into a structure, the same volume of air will be evacuated from the structure. Ordinary exhaust fans, such as located in kitchen areas, laundry areas, bathroom areas, or other, may be used for the purpose of exhausting stale air from the structure. The exhaust fans may be controlled as discussed above. However, having the exhaust fan 98 and its associated structure provides the advantage of working in conjunction with the fan 66 and the control elements discussed above.

Contemporary microprocessors may be programmed to perform many different tasks in response to sensed information. For contemporary structures, including homes, many different types of information may be sensed and used to provide predetermined functions, such as moving panels, as in the embodiment of the door 210, controlling the functioning of blowers/fans, and timing cycles relative to the blowers/fans, a heat strip, if so desired, and other functions.

It will be noted that while reference has been made to electronically controlling the damper actuators in response to desired information, it will be obvious that the dampers, and the fans, may be controlled by a timer, or in any other way, including manually, as desired.

While the door 10 is an ideal door structure for replacing existing exterior doors. For new construction, a door structure 140 is preferred, where a ventilator assembly 138 is placed in a transom area immediately above a typical exterior solid core door for a structure 126.

Figure 4:
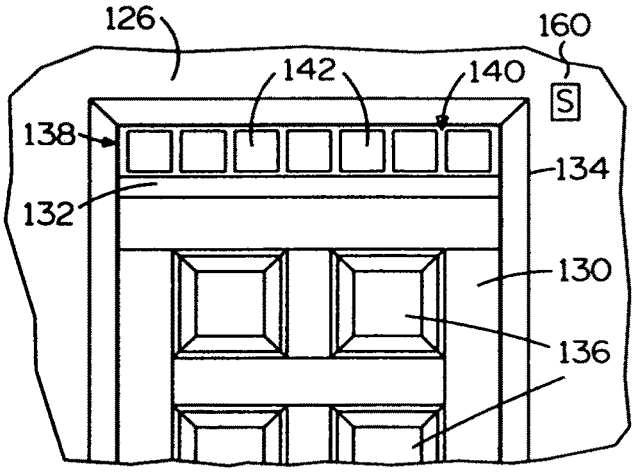
FIG. 4 is a partial front view of an alternate embodiment of the present invention.
Figure 5:
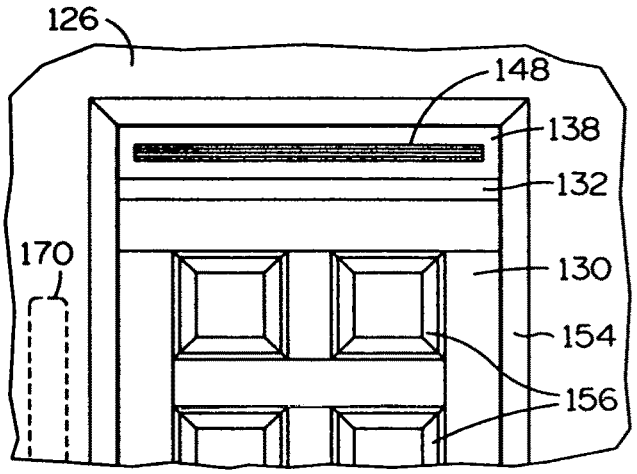
FIG. 5 is a partial rear view of the embodiment of FIG. 4.

FIG. 4 is a schematic representation of the upper exterior portion of the door structure 140. FIG. 5 is a an inside schematic representation of the inside upper portion of the door structure 140. For the following discussion, attention may be directed to both FIGS. 4 and 5.

The door assembly 140 includes a typical solid core exterior door 130 located in a structure 126, with a transom area 132 directly above the door 130. An exterior door jamb 134 is disposed about the door 130 and the transom area 132. The ventilator assembly 138 is disposed in the transom area 132. The ventilator assembly 138 is substantially identical to the ventilator assembly 38. The difference is simply that the ventilator assembly 138 is disposed in the transom area 132 above the door 130 and thus extends through a wall of the structure 126. Electrical and electronic elements will also be located in the transom area 132.

Appropriate wiring for the electrical and electronic elements associated with the ventilator assembly 140 may thus be wired as part of the wiring for the structure 126 and disposed in the transom area 132. This eliminates the transfer of electrical power to the ventilator assembly 38 of the door 10 through a hinge or by any other appropriate structure.

In FIG. 4, the ventilator assembly 138 includes a ventilator assembly housing 140 with a plurality of grills or screens 142 secured to the housing 140. Within the housing 140 are the corresponding elements for the ventilator assembly 38 of FIG. 1, including a damper and damper actuator, at least a single air filter, a fan housing and fan within the fan housing, an opening in the fan housing through which air flows into the fan housing and an outer opening in the fan housing through which air flows out of the fan housing, and a heat sink at the outer opening in the fan housing. The ventilator housing also includes thermal barrier elements.

Decorative panels or elements 136 are also shown on the door 130.

In FIG. 5, an inside view of the door 130 is shown, with an inside or interior door jamb 154 also shown. Decorative panels or elements 156 are also shown.

In the transom area 132 the ventilator assembly 138 is shown with a heat sink 148 through which fresh air is blown horizontally into the structure 126.

Like the door 10 of FIGS. 1 and 3, a lower housing may be provided for exhausting stale air through the door 130.

An alternative to placing a ventilator assembly in a door or in a transom area, a ventilator assembly may be placed vertically in a door side light area or adjacent to a door, or where desired.

In FIG. 5, a ventilator assembly 170 is schematically illustrated in dotted line adjacent to the door 150 in the structure 126 in a vertical orientation.

The air flow through the ventilator assembly 170 is horizontal, as with the ventilator assemblies 38 and 140. The ventilator assembly 170, like the ventilator assembly 140, has the advantage of being pre-wired in new construction, or to be direct hard wired for remodeling existing structures.

If desired, one assembly 170 may be inserted into each door side light, one assembly for bringing fresh air into a structure, and a second assembly 170 for exhausting stale inside air out of the structure.

While the principles of the invention have been made clear in illustrative embodiments, there will be immediately obvious to those skilled in the art many modifications of structure, arrangement, proportions, the elements, materials, and components and methods used in the practice of the invention, and otherwise, which are particularly adapted to specific environments and operative requirements, without departing from those principles. The appended claims are intended to cover and embrace any and all such modifications, within the limits only of the true spirit and scope of the invention.

What is claimed is:

1. An exterior door for providing a flow of fresh air into a structure comprising in combination:

a door frame including a pair of spaced apart stiles and a top rail and a bottom rail secured to the spaced apart stiles;

an outside skin secured to the door frame;

an opening in the outside skin;

an inside skin secured to the door frame;

an opening in the inside skin;

an opening in the top rail;

an upper housing extending through the opening in the top rail and through the openings in the outside skin and the inside skin;

an intake opening in the upper housing for receiving the flow of fresh air into the upper housing;

a damper for controlling the flow of fresh air into the upper housing;

an actuator for moving the damper;

an inside opening in the upper housing adjacent to the opening in the inside skin through which the flow of fresh air flows through the door;

a fan housing disposed in the upper housing;

a fan disposed in the fan housing for bringing the flow of fresh air into the upper housing and into the fan housing and for providing the flow of fresh air through the fan housing and through the inside opening in the upper housing and the opening in the inside skin and horizontally through the door and into the structure.

2. The exterior door of claim 1 which includes a screen covering the outside opening in the upper housing.

3. The exterior door of claim 1 which further includes a filter in the upper housing through which the flow of fresh air flows.

4. The exterior door of claim 1 which includes a charcoal filter and a HEPA filter for filtering the flow of fresh air into the upper housing.

5. The exterior door of claim 1 which further includes a heat sink disposed in the inside opening in the upper housing through which the flow of fresh air flows from the fan housing into the structure.

6. The exterior door of claim 5 in which the heat skink is a honeycomb aluminum heat sink.

7. The exterior door of claim 1 which includes a thermal barrier dividing the upper housing into an outside portion and an inside portion for preventing heat transfer from the outside portion to the flow of fresh air through the inside portion.

8. The exterior door of claim 7 in which the thermal barrier is a plastic element between the inside and outside portions of the upper housing.

9. The exterior door of claim 7 in which the thermal barrier is an air gap between the inside and outside portions of the upper housing.

10. A ventilator assembly for bringing a flow of fresh air into a structure comprising in combination:

a ventilator assembly housing;

a fan housing in the ventilator assembly housing;

an outside opening in the ventilator assembly housing through which the flow of fresh air flows into the fan housing;

an inside opening in the fan housing through which the flow of fresh air flows from the fan housing horizontally into the structure;

a movable damper for controlling the flow of fresh air flowing into the ventilator assembly housing;

an actuator for moving the movable damper; and a fan in the fan housing for providing the flow of fresh air into the ventilator assembly housing and into the fan housing and outwardly horizontally from the fan housing through the inside opening into the structure.

11. The ventilator assembly of claim 10 which includes a heat sink at the inside opening in the fan housing through which the flow of fresh air flows horizontally from the fan housing into the structure.

12. The ventilator assembly of claim 10 which further includes a screen secured to the ventilator assembly housing at the outside opening through which the flow of fresh air flows into the ventilator assembly housing.

13. The ventilator assembly of claim 10 which includes a thermal barrier in the ventilator assembly housing separating the ventilator assembly housing into an outside portion and an inside portion for limiting thermal conductivity into the flow of fresh air as it flows through the outside and inside portions of the ventilator assembly housing and into the fan housing.

14. The ventilator assembly of claim 13 in which the thermal barrier is a plastic element.

15. The ventilator assembly of claim 13 in which the thermal barrier comprises an air gap between the inside and outside portions of the ventilator assembly housing.

16. The ventilator assembly of claim 10 which includes a filter disposed in the ventilator assembly housing adjacent to the outside opening.

17. The ventilator assembly of claim 10 in which the flow of fresh air flows horizontally into the ventilator assembly housing and horizontally from the fan housing into the structure.

18. The ventilator assembly of claim 10 in which the ventilator assembly is disposed in a stile and rail door.

19. The ventilator assembly of claim 18 in which the ventilator assembly is disposed in a rail of the stile and rail door.

* * * * *